US009038732B2

(12) United States Patent
Eikemo

(10) Patent No.: US 9,038,732 B2
(45) Date of Patent: May 26, 2015

(54) METHOD AND DEVICE FOR RISERLESS DRILLING FLUID RECOVERY

(71) Applicant: AGR SUBSEA AS, Straume (NO)

(72) Inventor: Bernt Eikemo, Bergen (NO)

(73) Assignee: AGR SUBSEA AS, Straume (NO)

( * ) Notice: Subject to any disclaimer, the term of this patent is extended or adjusted under 35 U.S.C. 154(b) by 0 days.

(21) Appl. No.: 14/356,701

(22) PCT Filed: Oct. 25, 2012

(86) PCT No.: PCT/NO2012/050207
§ 371 (c)(1),
(2) Date: May 7, 2014

(87) PCT Pub. No.: WO2013/070084
PCT Pub. Date: May 16, 2013

(65) Prior Publication Data

US 2014/0305657 A1 Oct. 16, 2014

(30) Foreign Application Priority Data

Nov. 8, 2011 (NO) ..... 20111534

(51) Int. Cl.
*E21B 7/12* (2006.01)
*E21B 7/20* (2006.01)
(Continued)

(52) U.S. Cl.
CPC ..... *E21B 21/001* (2013.01); *E21B 33/035* (2013.01); *E21B 33/043* (2013.01); *E21B 7/20* (2013.01)

(58) Field of Classification Search
CPC ..... E21B 7/12; E21B 7/20; E21B 21/001; E21B 41/04
USPC ..... 166/351, 338, 358, 368; 175/5, 207, 175/209
See application file for complete search history.

(56) References Cited

U.S. PATENT DOCUMENTS 3,252,529 A * 5/1966 Fischer ..... 175/7
3,527,294 A * 9/1970 Courtright, Jr. et al. ..... 166/356
(Continued)

FOREIGN PATENT DOCUMENTS

GB 2 424 432 A 9/2006
WO WO 2005/049958 A1 6/2005

OTHER PUBLICATIONS

Dave Smith et al., Deepwater Riserless Mud Return System for Dual Gradient Tophole Drilling, SPE/IADC 130308, 2010, pp. 1-22.
(Continued)

*Primary Examiner* — Matthew Buck
(74) *Attorney, Agent, or Firm* — Foley & Lardner LLP

(57) ABSTRACT

A method and a device for enabling the use of riserless drilling fluid recovery from a seabed-based borehole (1) which is to be drilled by means of a casing (26), the casing (26) being provided with a drill bit (28) at its lower portion and with an inner wellhead (30) at its upper portion, and there being a conductor casing (6), which has an outer wellhead (8), in the seabed (2), the method including: —providing a suction module (12) with a dividable adapter (16) which fits complementarily in the outer wellhead (8); —drilling a length of the borehole (1) by means of the casing (26) extending through the suction module (12), while, at the same time, drilling fluid is flowing via the suction module (12) from the borehole (1); —subsequently pulling the adapter (16) up from the outer wellhead (8) and dividing the adapter (16); and—lowering the casing (26) with the inner wellhead (30) through the suction module (12) and the adapter (16) to its position in the outer wellhead (8).

4 Claims, 4 Drawing Sheets

(51) Int. Cl.

| | |
|---|---|
| ***E21B 41/04*** | (2006.01) |
| ***E21B 21/00*** | (2006.01) |
| ***E21B 33/035*** | (2006.01) |
| ***E21B 33/043*** | (2006.01) |

(56) References Cited

U.S. PATENT DOCUMENTS

| | | | | | |
|---|---|---|---|---|---|
| 3,656,549 | A | * | 4/1972 | Holbert et al. | 166/356 |
| 3,789,922 | A | * | 2/1974 | Knief | 166/351 |
| 3,973,635 | A | * | 8/1976 | Gatlin et al. | 175/7 |
| 4,149,603 | A | * | 4/1979 | Arnold | 175/7 |
| 4,813,496 | A | * | 3/1989 | Rohweller et al. | 175/7 |
| 4,904,119 | A | * | 2/1990 | Legendre et al. | 405/228 |
| 5,184,686 | A | * | 2/1993 | Gonzalez | 175/5 |
| 5,560,436 | A | * | 10/1996 | Awad et al. | 175/7 |
| 5,660,234 | A | * | 8/1997 | Hebert et al. | 166/368 |
| 7,431,081 | B2 | * | 10/2008 | Stave | 166/236 |
| 2004/0065474 | A1 | * | 4/2004 | Turner et al. | 175/5 |
| 2005/0152749 | A1 | * | 7/2005 | Anres et al. | 405/224 |
| 2011/0017511 | A1 | * | 1/2011 | Payne | 175/7 |
| 2011/0158752 | A1 | * | 6/2011 | Hitchin | 405/232 |

OTHER PUBLICATIONS

J.H. Cohen et al., Gulf of Mexico's First Application of Riserless Mud Recovery for Top-Hole Drilling—A Case Study, OTC 20939, 2010, pp. 1-13.

International Search Report and Written Opinion, Jan. 23, 2013, 4 pages.

* cited by examiner

METHOD AND DEVICE FOR RISERLESS DRILLING FLUID RECOVERY

This invention relates to a method for riserless drilling fluid recovery. More particularly, it relates to a method for riserless drilling fluid recovery from a seabed-based borehole which is to be drilled by means of a casing, the casing being provided with a drill bit at its lower portion and with an inner wellhead at its upper portion, and there being a conductor casing with an outer wellhead in the seabed. The invention also includes a device for practising the method.

A subsea well is often established by a permanent guide base first being installed on the seabed. A conductor casing with an outer wellhead, usually in the form of a low-pressure wellhead, fitted on it has been lowered into the ground in such a way that the outer wellhead is just above the seabed.

For various reasons, environmental ones among others, it is usual to arrange a suction module in the outer wellhead to collect drilling fluid that is flowing up from the borehole during the further drilling.

WO 2005/049958 shows a wellhead to which a suction module has been connected.

US 2011/0017511 deals with a method of running tubular lengths into a well from a position near the seabed.

SMITH, D. et al. "Deepwater Riserless Mud Return System for Dual Gradient Tophole Drilling". SPE/IDAC 130308, and COHEN, J. H. et al. "Gulf of Mexico's First Application of Riserless Mud Recovery for Tophole Drilling". OTC 20939 deal with further background material.

To achieve a rational further drilling of the borehole, casing with a drill bit fitted on it is used to drill the first part of the borehole after the conductor casing has been positioned. The casing is not pulled up, but remains in the well and is cemented to the ground after having been drilled to the desired depth. Thus, the method is conditional on the casing being provided with an inner wellhead at its upper portion, usually in the form of a high-pressure wellhead.

The inner wellhead is formed to fit inside the outer wellhead; that is to say, into the same detail that the suction module is in. Thus, the part of the suction module that fits into the outer wellhead and the inner wellhead have approximately the same external diameters. Thus, the inner wellhead cannot be moved through the suction module.

A prior-art suction module thus cannot be used when the borehole is to be drilled by means of a casing.

The invention has for its object to remedy or reduce at least one of the drawbacks of the prior art or at least provide a useful alternative to the prior art.

The object is achieved through features which are specified in the description below and in the claims that follow.

In a first aspect of the invention, a method is provided for riserless drilling fluid recovery from a seabed-based borehole which is to be drilled by means of a casing, the casing being provided with a drill bit at its lower portion and with an inner wellhead at its upper portion, and there being a conductor casing, which has an outer wellhead, in the seabed, the method being characterized by including:

- providing a suction module with a dividable adapter which fits complementarily into the outer wellhead;
- drilling a length of the borehole by means of the casing extending through the suction module, while, at the same time, drilling fluid is flowing via the suction module from the borehole;
- subsequently pulling the adapter up from the outer wellhead and dividing the adapter; and

- lowering the casing with the inner wellhead through the suction module and the adapter into its position in the outer wellhead.

When the casing has been moved down via the suction module to approximately its final position in the borehole, the adapter may be moved out of the outer wellhead and opened. The inner wellhead may then be moved through the suction module with the opened adapter and down into its final position. The suction module may then be pulled up to the surface.

In a second aspect of the invention, a suction module is provided for use in riserless drilling fluid recovery from a seabed-based borehole which is drilled by means of a casing, the casing being provided with a drill bit at its lower portion and with an inner wellhead at its upper portion, and there being a conductor casing with an outer wellhead in the seabed, and the suction module being characterized by being provided with a dividable adapter which fits complementarily in the outer wellhead.

The dividable adapter may be hingingly connected to the suction module. In its active position, the adapter may be locked to the suction module, for example by means of an ROV-releasable lock.

The method and the device according to the invention enable the use of the combination of riserless- and casing-based drilling of a portion of a borehole, which has substantial advantages with respect to both efficiency and environmental conditions.

In what follows, an example of a preferred embodiment is described, which is visualized in the accompanying drawings in which.

Figure 1:
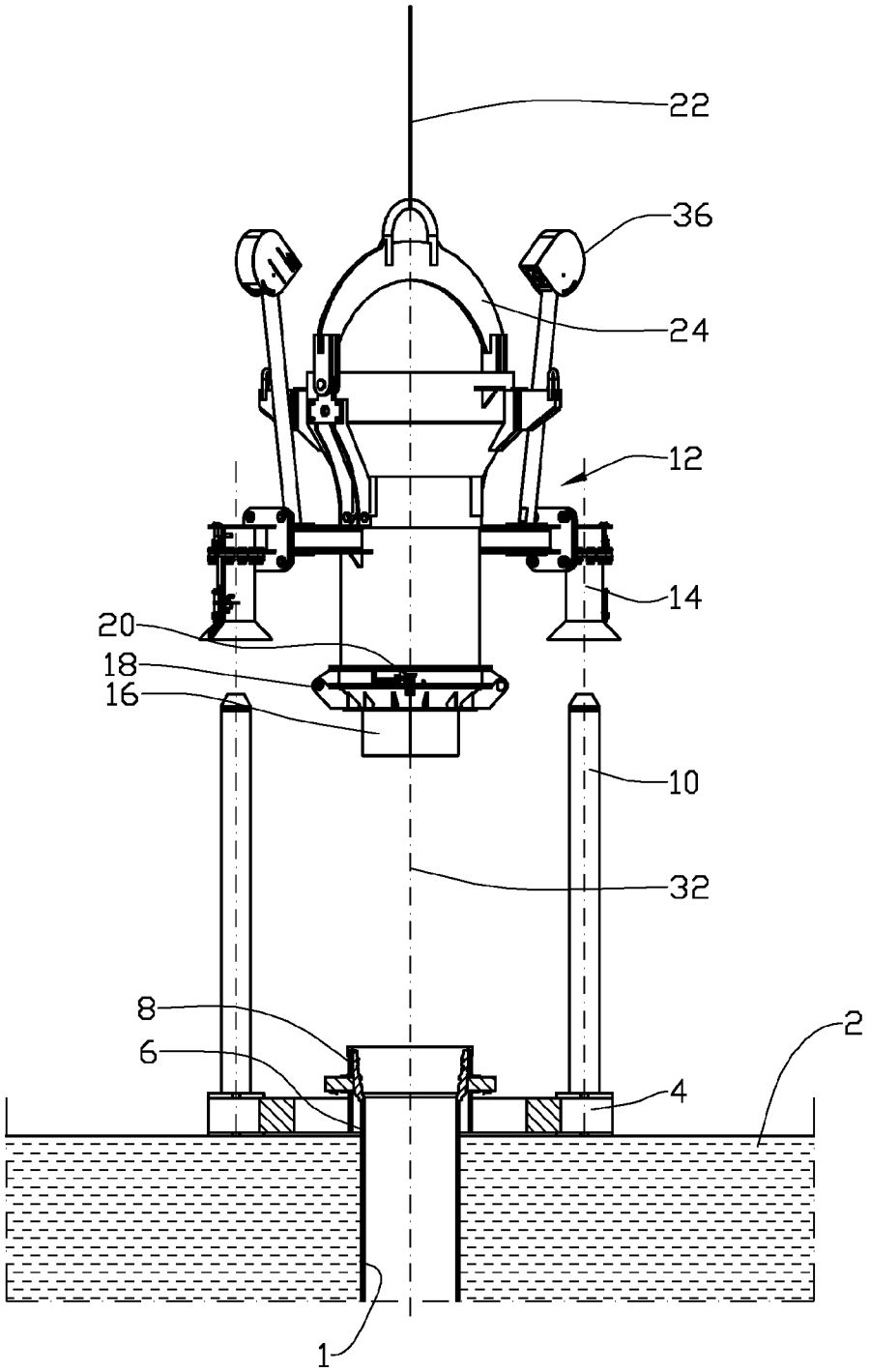
FIG. 1 shows, in section, a borehole at an early stage, in which a suction module with an adapter according to the invention is being lowered to a conductor casing.

In the drawings, the reference numeral 1 indicates a borehole started in the seabed 2. A guide base 4 is placed on the seabed 2 and a conductor casing 6 with an outer wellhead 8, here in the form of a low-pressure wellhead, fitted on it has been run through the guide base 4 and somewhat into the seabed 2.

The guide base 4 is provided with guide columns 10 projecting upwards. A suction module 12 is provided with guide pipes 14 fitting complementarily on the guide columns 10. At its central lower portion, the suction module 12 is formed with a dividable tubular adapter 16 which fits externally into the outer wellhead 8, see FIG. 2. The adapter 16 is connected to the suction module 12 by means of hinges 18 and is held in its active position by means of ROV-releasable locks 20. (ROV: Remotely Operated Vehicle=a small submarine).

The suction module 12 is lowered by means of a wire 22 which is connected to the suction module 12 by means of an articulated yoke 24. The yoke 24 is then pivoted into its idle, swung-out position by the wire 22 being further lowered.

A casing 26 is provided, at its lower end portion, with a drill bit 28 and is provided, at its upper end portion, with an inner wellhead 30, here in the form of a high-pressure wellhead.

After the adapter 16 has been placed in the outer wellhead 8 and the suction module 12 has been connected to the necessary components such as hoses and measuring equipment, not shown, the suction module 12 is ready to receive and forward drilling fluid which is used during the further drilling of the borehole 1.

Figure 2:
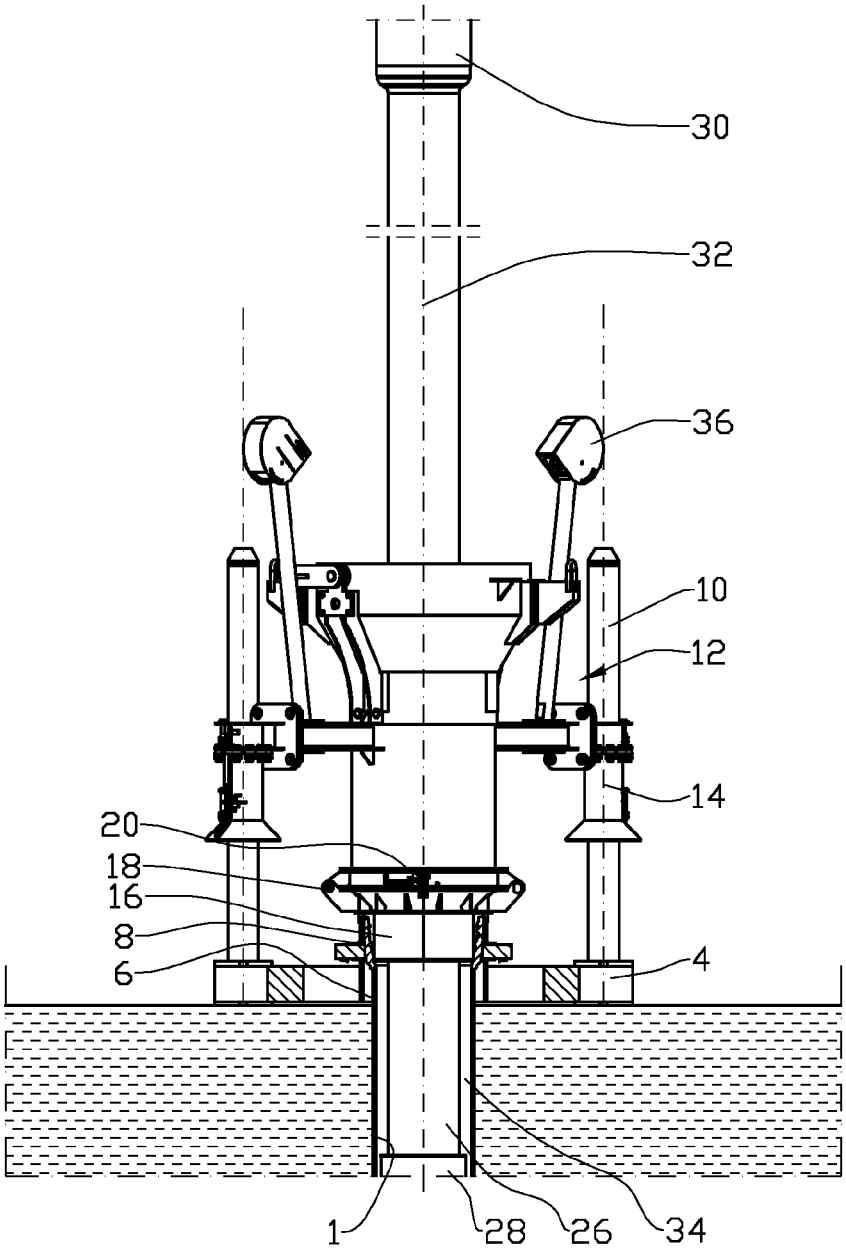
FIG. 2 shows the same as FIG. 1, but after a casing has been arranged for further drilling of the borehole.

The casing 26 fitted with the drill bit 28 is moved down through the suction module 12 while simultaneously being rotated around its longitudinal axis 32, see FIG. 2. During the drilling, drilling fluid is flowing down through the casing 26, through the drill bit 28 and back to the suction module 12 via an annulus 34 surrounding the casing 26 in the seabed 2. The drilling-fluid level in the suction module is monitored by means of the instruments 36.

As the inner wellhead 30 of the casing 26 is approaching the adapter 16, the adapter 16 is lifted out of the outer wellhead 8 by means of two wires 38 which are connected to the suction module 12. The yoke 24 may then stay swung out.

Figure 3:
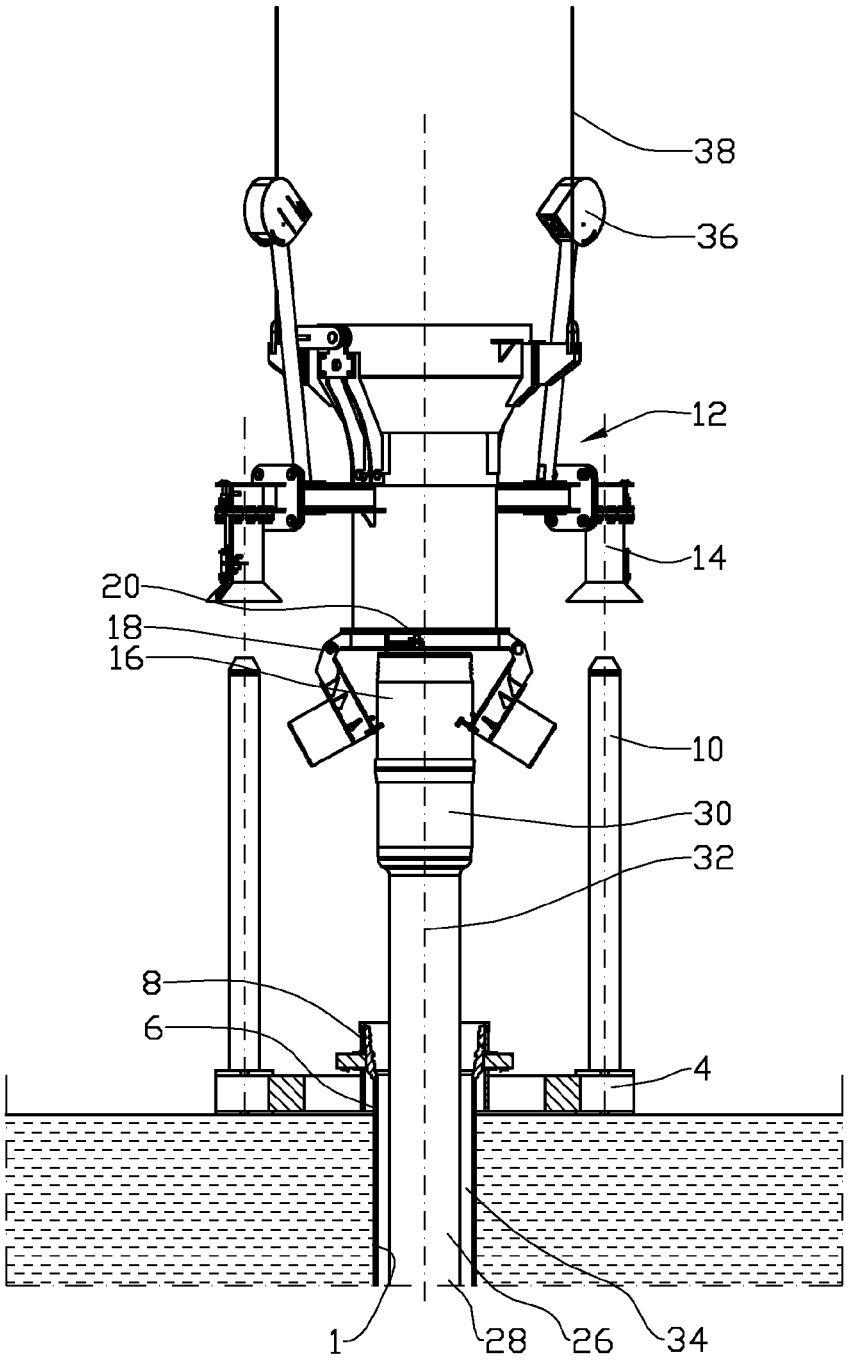
FIG. 3 shows the same as FIG. 2, but after the adapter has been pulled up and divided in order for the casing to be moved further down into the borehole.
Figure 4:
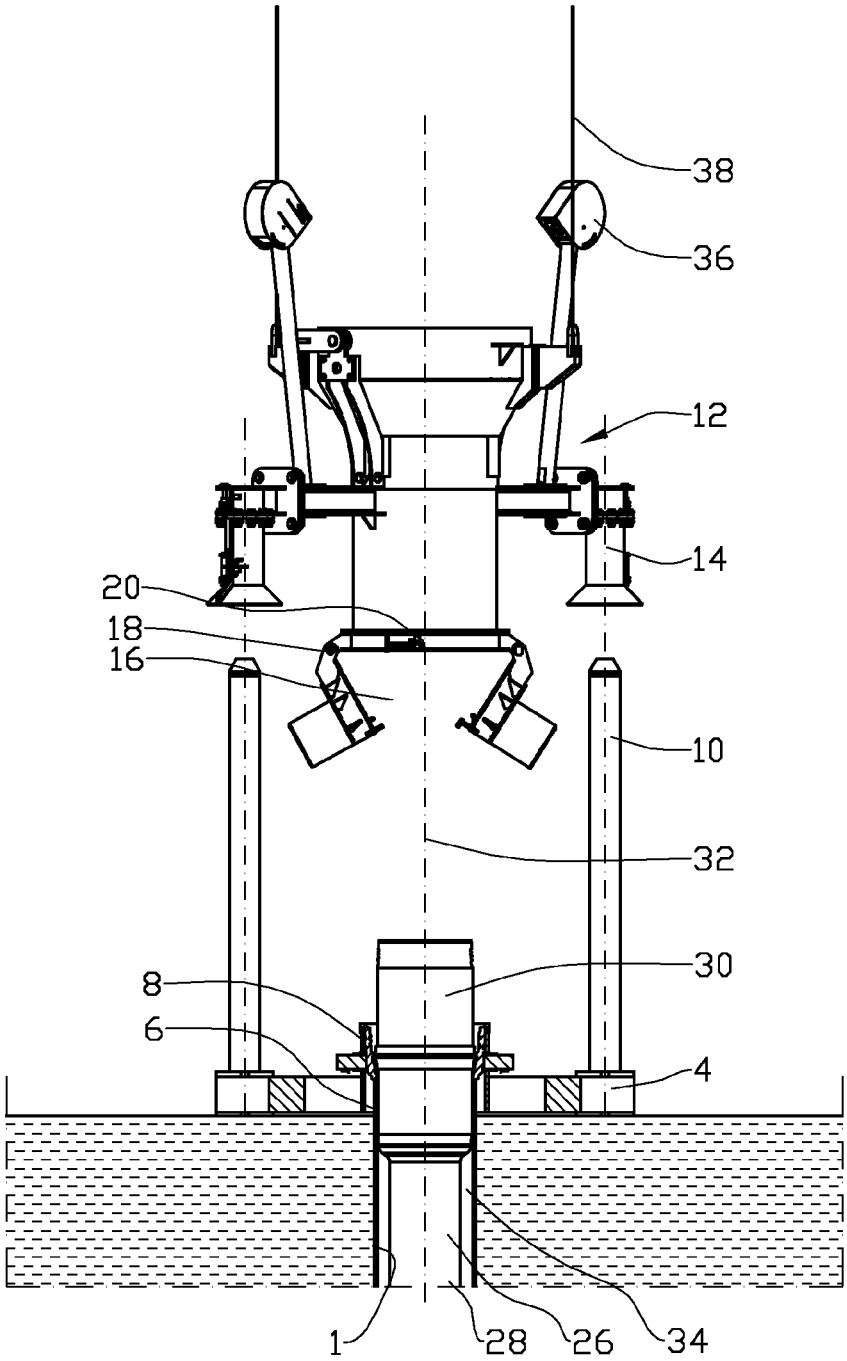
FIG. 4 shows the borehole with the casing placed in its final position.

After an ROV, not shown, has released the releasable locks 20, the adapter 16 is opened sufficiently for the inner wellhead 30 to be moved through the adapter 16, see FIG. 3. The casing 26 is then moved further down until the inner wellhead 30 gets to its final position in the outer wellhead 8, see FIG. 4.

The invention claimed is:

1. A method for riserless drilling fluid recovery from a seabed-based borehole configured to be drilled by a casing comprising a drill bit at its lower portion and an inner wellhead at its upper portion, and a conductor casing comprising an outer wellhead placed on the seabed, the method comprising:

providing a suction module with a dividable adapter fit complementarily in the outer wellhead;

drilling a length of the borehole with the casing extending through the suction module, while drilling fluid simultaneously flows from the borehole via the suction module;

subsequently pulling the dividable adapter up and out of the outer wellhead and dividing the dividable adapter; and lowering the casing with the inner wellhead through the suction module and the dividable adapter into a position in the outer wellhead.

2. The method in accordance with claim 1, wherein the dividable adapter is hingedly connected to the suction module.

3. The method in accordance with claim 1, wherein the dividable adapter is locked to the suction module by a remotely operated vehicle-releasable lock.

4. The method in accordance with claim 1, wherein the dividable adapter is configured to divide apart and permit passage of the inner wellhead therethrough.

* * * * *